United States Patent [19]

Simmonds et al.

[11] Patent Number: 4,848,093

[45] Date of Patent: Jul. 18, 1989

[54] APPARATUS AND METHOD FOR REGULATING TEMPERATURE IN A CRYOGENIC TEST CHAMBER

[75] Inventors: Michael B. Simmonds, Del Mar; Ronald E. Sager, Carlsbad, both of Calif.

[73] Assignee: Quantum Design, San Diego, Calif.

[21] Appl. No.: 244,947

[22] Filed: Sep. 15, 1988

Related U.S. Application Data

[63] Continuation-in-part of Ser. No. 87,465, Aug. 24, 1987, Pat. No. 4,791,788.

[51] Int. Cl.[4] ..... F17C 13/02

[52] U.S. Cl. ..... 62/49.1; 62/50.1; 62/51.1

[58] Field of Search ..... 62/49, 55, 514 R

[56] References Cited

U.S. PATENT DOCUMENTS

| | | | |
|---|---|---|---|
| 3,729,946 | 5/1973 | Massey | 62/55 |
| 4,192,147 | 3/1980 | Gilbert et al. | 62/49 |
| 4,280,499 | 7/1981 | Sguazzi | 62/514 R |
| 4,302,943 | 12/1981 | Niemann et al. | 62/49 |
| 4,485,640 | 12/1984 | Bon Mardion et al. | 62/514 R |
| 4,495,782 | 1/1985 | Salour et al. | 62/514 R |
| 4,578,963 | 4/1986 | Sitte | 62/514 R |
| 4,607,490 | 8/1986 | Siedel et al. | 62/51 |

*Primary Examiner*—Ronald C. Capossela

*Attorney, Agent, or Firm*—Knobbe, Martens, Olson & Bear

[57] ABSTRACT

An apparatus and method for regulating the temperature in a cryogenic test chamber. Liquid helium is drawn into a test chamber located in a cryogenic vessel through a capillary tube which is spaced apart from the test chamber. The capillary tube is thermally insulated from the liquid helium. In a high temperature mode, a heater element heats the capillary tube to a temperature just high enough to boil the liquid helium as the helium is drawn through the capillary tube into the test chamber, thereby insuring that only gaseous helium enters the test chamber and preventing any tendency of the temperature in the test chamber to oscillate when the test chamber is warmed to temperature only slightly higher than the temperature of the liquid helium. In a low temperature mode the heater element heats the capillary tube sufficiently to substantially prevent any helium from flowing into the test chamber, thereby facilitating cooling of the test chamber to temperature below the temperature of the liquid helium by evacuating the test chamber until the liquid therein boils at the desired temperature.

28 Claims, 1 Drawing Sheet

APPARATUS AND METHOD FOR REGULATING TEMPERATURE IN A CRYOGENIC TEST CHAMBER

This is a continuation-in-part of co-pending patent application Ser. No. 07/087,465, filed Aug. 24, 1987 now U.S. Pat. No. 4,791,788.

BACKGROUND OF THE INVENTION

The present invention relates generally to temperature regulation and more particularly to an apparatus and method for regulating the temperature in a cryogenic test chamber.

Apparatus for subjecting a test specimen to cryogenic temperatures typically includes an enclosed, thermally-insulated vessel into which a fluid, generally a liquid at a cryogenic temperature, is introduced. For example, liquid helium having a temperature of about 4.2 degrees Kelvin is frequently used for this purpose. The specimen is placed in a test vessel which in turn is located in a thermally-insulated test chamber inside the cryogenic vessel. Some of the liquid is drawn from the cryogenic vessel into the test chamber through a passageway such as a coupling tube by partially evacuating the test chamber to create a pressure differential between the interior of the test chamber and the interior of the remainder of the cryogenic vessel. As the liquid enters the test chamber it cools the test chamber, and the specimen enclosed in the test vessel located therein, to the cryogenic temperature of the liquid.

The apparatus is operated in a high temperature mode if it is desired to subject the specimen to a temperature higher than that of the liquid. A heater located in 10 the test chamber is energized, boiling the liquid and heating the resulting gas until the desired temperature has been reached. A thermostatic control can be used to maintain any desired temperature higher than the temperature of the liquid for as long a time as desired.

A low temperature mode of operation is utilized if it is desired to subject the specimen to a temperature lower than that of the liquid. The test chamber is evacuated until the pressure therein is low enough to cause the liquid to boil at the desired temperature. By selecting a suitable pressure and continuing to evacuate the test chamber as the liquid boils so as to maintain that pressure, any desired temperature down to about 1.5 degrees Kelvin can be reached. Such a temperature can be maintained until all the liquid in the test chamber has boiled away, and then more liquid must be admitted to the chamber and the process repeated.

The coupling tube through which the liquid is admitted to the test chamber must be large enough in diameter to assure a sufficiently high liquid mass flow rate into the test chamber to cool the chamber to the temperature of the liquid in a reasonably short time. However, when the apparatus is being operated in the low temperature mode, the pressure differential which results from the continuous evacuation of the chamber tends to draw more liquid into the chamber through the coupling tube, and the larger the tube the faster the liquid is drawn in. This is undesirable because the newly-admitted liquid tends to raise the temperature in the chamber, thereby making it more difficult to attain the desired lower temperature. This problem can be solved, at least in theory, by providing a mechanical valve to close the coupling tube during operation in the low temperature mode, but the difficulty of constructing reliable low temperature valves has limited the usefulness of this approach.

A different problem is encountered when operating in the high temperature mode, especially when trying to attain a temperature between about 4.2 and 20 degrees Kelvin. Energizing the heater boils some of the liquid in the test chamber, but absorption by the boiling liquid of latent heat of vaporization ("latent heat of vaporization" is heat which is absorbed by the liquid as it changes to its gaseous phase) tends to cool the chamber, thereby offsetting the warming effect of the heater. Thus, the temperature in the chamber tends to remain at about 4.2 degrees until all the liquid has been changed into its gaseous phase, at which time there is a sudden jump in the temperature to about 20 degrees due to the effects of the heater, which now are concentrated entirely on the gas in the test chamber. If the heater is shut off in an effort to cool the chamber back down to the desired temperature, the gas gradually cools, but as it cools its pressure drops, tending to draw more liquid into the chamber through the coupling tube. This accelerates the cooling process until the temperature drops below the desired temperature. Energizing the heater causes the cycle to repeat. Thus, the system behaves as a relaxation oscillator, the temperature oscillating back and forth between 4.2 and 20 degrees rather than stabilizing at the desired temperature.

In addition to these problems, the presence of liquid at cryogenic temperature in the test chamber during the high temperature mode of operation can interfere with insertion and removal of samples and cause errors in certain types of measurements, difficulties which would be avoided if there were no liquid in the chamber.

It will be apparent from the foregoing that there is a need for a way to achieve reliable temperature regulation in a cryogenic test chamber, especially at temperatures below about 20 degrees Kelvin, and to avoid the presence of liquid at cryogenic temperatures in the immediate vicinity of the test chamber during operation at temperatures higher than the cryogenic temperature.

SUMMARY OF THE INVENTION

The present invention provides an apparatus and method for accurately regulating the temperature in a test chamber in a cryogenic vessel at any temperature between about 1.5 and 300 degrees Kelvin by means of a controllably heated capillary tube spaced apart from the test chamber in the vessel. The capillary tube regulates the flow of fluid from the cryogenic vessel into the test chamber to permit any desired temperature to be maintained in the test chamber. In a high temperature mode of operation the capillary tube prevents any fluid in a liquid phase from entering the test chamber.

In a preferred embodiment, temperature regulation apparatus according to the invention comprises a cryogenic vessel adapted to contain a fluid in a liquid phase at a cryogenic temperature, a capillary tube located in the cryogenic vessel, capillary heater means, means defining a test chamber in the cryogenic vessel but spaced apart from the capillary tube, fluid flow means defining a fluid flow path between the capillary tube and the test chamber, test chamber heater means to heat the test chamber, and evacuation means to partially evacuate the test chamber to draw fluid from the cryogenic vessel through the capillary tube and the fluid flow means into the test chamber.

The apparatus regulates the temperature in the test chamber by maintaining the fluid therein at a desired temperature. In a high temperature mode, the capillary heater means warms the capillary tube sufficiently to boil any liquid flowing therein, changing the phase of the fluid from liquid to gas as the fluid is drawn through the capillary tube into the test chamber. The test chamber heater means warms any gas in the test chamber to the desired temperature and then maintains the gas at that temperature.

In a medium temperature mode, the fluid remains in its liquid phase without undergoing any net change in temperature as it is drawn through the capillary tube into the test chamber. The fluid is thereby maintained at the cryogenic temperature in the test chamber.

Finally, in a low temperature mode the fluid remains in its liquid phase as it is drawn through the capillary tube into the test chamber until a reservoir of liquid has accumulated in the test chamber. Then the capillary heater means warms the capillary tube sufficiently to substantially prevent the flow of any more fluid through the capillary tube. The evacuation means thereupon reduces the pressure in the test chamber sufficiently to lower the boiling temperature of the liquid therein to the desired temperature and evacuates any gas produced as the liquid boils, thereby maintaining the liquid at the desired temperature.

Liquid helium at a temperature of about 4.2 degrees Kelvin is preferably used. In the low temperature mode, any temperature between that temperature and about 1.5 degrees Kelvin can be attained, and in the high temperature mode any temperature between about 4.2 degrees and about 20 degrees can be attained. In fact, in the high temperature mode any temperature up to normal room temperature (about 300 degrees Kelvin) is readily attainable simply by applying more heat to the gas in the test chamber.

The capillary heater means preferably comprises a heater element, a temperature sensor, and control means responsive to the sensor to control the quantity of heat provided by the heater element and thereby to raise the temperature of the capillary tube to a desired value.

Satisfactory results are obtained in the high temperature mode by warming the capillary tube to about 10 degrees Kelvin, a temperature which is high enough to boil any liquid flowing in the capillary tube but no so high as to unduly restrict the rate of mass flow through the capillary tube. Such a temperature can be conveniently maintained by using for the sensor a material which conducts an electric current in a superconducting mode at any temperature less than about 10 degrees Kelvin, the control means being able to measure the temperature of the capillary tube by determining whether the sensor is in its superconducting mode.

In the low temperature mode, satisfactory results have been obtained by heating the capillary tube to about 300 degrees Kelvin, at which temperature the rate of mass flow is reduced by some two orders of magnitude. This reduction is sufficient to amount to substantially a cut-off of any fluid flow through the capillary tube into the test chamber.

The apparatus preferably includes a test vessel adapted to receive and enclose a test specimen in the test chamber to maintain the temperature of the specimen approximately equal to the temperature in the test chamber. The test chamber is preferably kept in thermal isolation from the liquid in the cryogenic vessel by enclosing it in isolation means such as thermal insulation.

The capillary tube is preferably thermally isolated from the liquid in the cryogenic vessel, for example by enclosing it in an elongated impedance chamber defined by a thermally insulating impedance capsule. The fluid flow means preferably comprises a coupling tube having a diameter larger than that of the capillary tube and extending from the capillary tube, out of the impedance chamber, and through the liquid in the cryogenic vessel to an opening into the test chamber.

The dimensions of the capillary tube must be selected according to the desired rate of mass flow of the fluid. Satisfactory results have been obtained by utilizing a capillary tube having an inner diameter of about 0.1 millimeters and a length of about ten millimeters together with a coupling tube having an outer diameter of about 0.6 millimeters in an impedance chamber having an inner diameter of about one millimeter and a length of about 100 millimeters.

According to the present invention a method of regulating the temperature in a cryogenic test chamber is provided that utilizes apparatus of the kind described above. The method comprises the initial steps of selecting a mode of operation and drawing fluid from the cryogenic vessel into the test chamber through a fluid flow path having a capillary tube by partially evacuating the test chamber. If a high temperature mode has been selected, the steps of applying sufficient heat to the capillary tube to boil any liquid flowing therein and thereby to change the phase of the fluid from liquid to gas as the fluid is drawn through the capillary tube into the test chamber, and applying sufficient heat to the gas in the test chamber to warm the gas to the desired temperature and thereafter to maintain the gas at said temperature, are carried out.

If a medium temperature mode has been selected, the step of maintaining the fluid in its liquid phase without any net change of temperature as the fluid is drawn through the capillary tube into the test chamber and thereby maintaining the fluid in the test chamber at the cryogenic temperature is performed, preferably simply by omitting to energize the capillary heater as the fluid flows through the capillary tube.

If a low temperature mode has been selected, the steps of accumulating a reservoir of the fluid in its liquid phase in the test chamber, applying sufficient heat to the capillary tube to substantially prevent the flow of any more fluid through the capillary tube, reducing the pressure in the test chamber sufficiently to lower the boiling temperature of the liquid in the test chamber to a desired temperature, and evacuating any gas produced as the liquid boils to maintain the liquid at said temperature are performed.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 2:
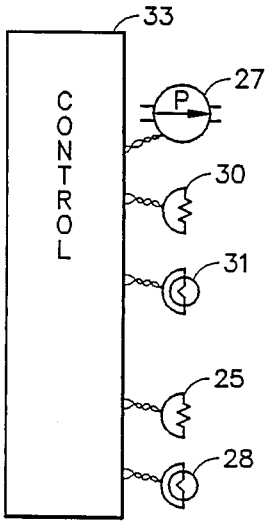
FIG. 2 is a simplified schematic diagram showing electrical connections to the electrical components of the apparatus of FIG. 1.

As shown in the drawings for purposes of illustration, the present invention is embodied in an apparatus and method for regulating the temperature in a cryogenic test chamber by controlling the phase and temperature of a cryogenic fluid as the fluid is drawn into the chamber through a capillary tube located apart from the chamber. Regulation of the temperature in such a chamber has been attempted by selectively applying heat to the fluid after the fluid has been drawn into the chamber, but this has been inadequate especially when reliable operation at a temperature of less than about 20 degrees Kelvin has been required.

Any desired temperature between about 1.5 and 300 degrees Kelvin can be accurately established and maintained in the cryogenic test chamber by utilizing the apparatus and method of the present invention. Any measurement errors and tendency toward oscillation when operating in a high temperature mode are avoided by preventing any fluid in a liquid phase from entering the test chamber, and difficulty in establishing or maintaining a desired temperature when operating in a low temperature mode are avoided by substantially preventing any fluid from entering the test chamber after a liquid reservoir has been accumulated.

Figure 1:
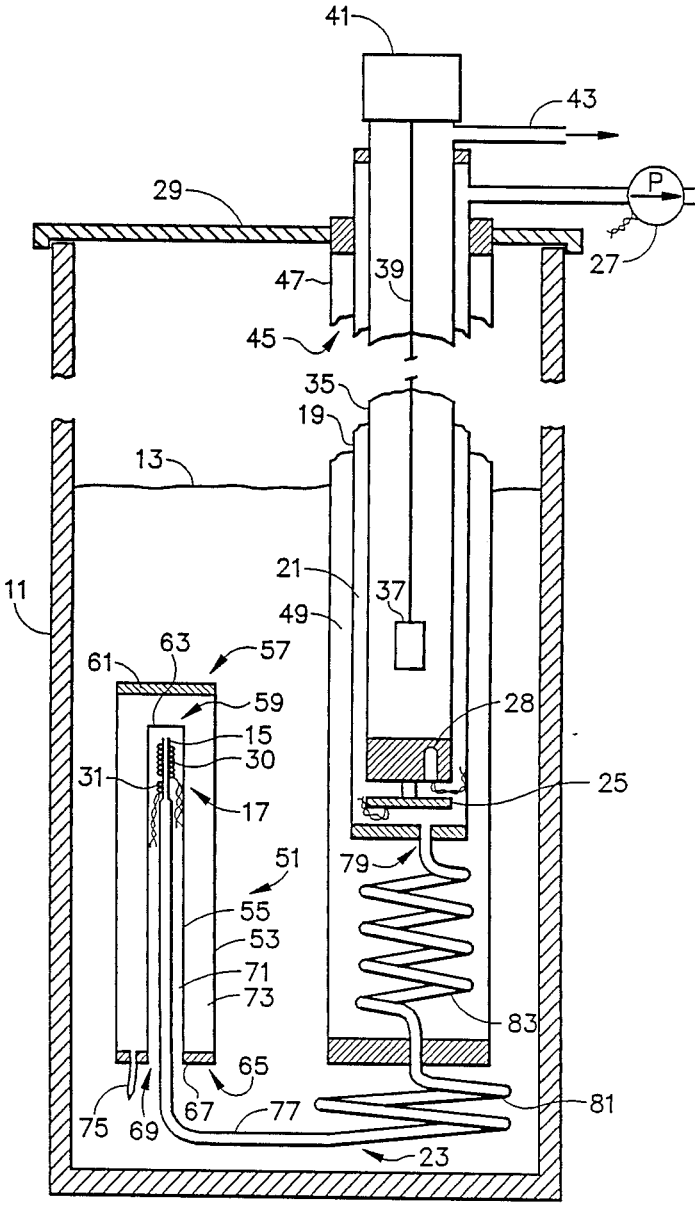
FIG. 1 is a sectional view of a cryogenic vessel containing a cryogenic liquid and temperature regulation apparatus according to the invention.

In a preferred embodiment, shown illustratively in FIG. 1, temperature regulation apparatus according to the invention comprises a cryogenic vessel 11 adapted to contain a fluid 13 in a liquid phase at a cryogenic temperature, a capillary tube 15 located in the cryogenic vessel 11, capillary heater means 17 in thermal communication with the capillary tube 15, means 19 defining a test chamber 21 in the cryogenic vessel 11 in spaced apart relation to the capillary tube 15, fluid flow means 23 defining a fluid flow path between the capillary tube 15 and the test chamber 21, test chamber heater means 25 in thermal communication with the test chamber 21, and evacuation means 27 such as a vacuum pump operative to partially evacuate the test chamber 21 to draw fluid from the cryogenic vessel 11 through the capillary tube 15 and the fluid flow means 23 into the test chamber 21.

The apparatus is operative to regulate the temperature in the test chamber 21 by maintaining the fluid therein at a desired temperature. The apparatus is operable in any of three modes: a high temperature mode, a medium temperature mode, and a low temperature mode. In the high temperature mode the capillary heater means 17 warms the capillary tube 15 sufficiently to boil any liquid flowing therein and thereby changes the phase of the fluid from liquid to gas as the fluid is drawn through the capillary tube 15 into the test chamber 21, and the test chamber heater means 25 warms any gas in the test chamber 21 to a desired temperature and thereafter maintains the gas at said temperature.

The capillary heater means 17 may raise the temperature of the fluid as it boils the fluid in the capillary tube 15. However, after the fluid has been boiled it passes through the fluid flow means 23 en route to the test chamber 21. The fluid flow means 23 is routed through the cryogenic vessel 11 in such a manner that the flow means 23 is immersed in and cooled by the fluid 13 in the vessel 11, and any gas flowing through the flow means 23 is thereby cooled back down to the cryogenic temperature before the gas reaches the test chamber 21. Thus, the gas is at cryogenic temperature when it arrives in the test chamber 21, and the test chamber heater 25 can then be used to warm the gas to any desired chamber higher than the cryogenic temperature. Since no fluid in a liquid phase enters the test chamber 21 during the high temperature mode of operation, there is no possibility of any temperature oscillations of the kind previously described.

In the medium temperature mode the fluid remains in its liquid phase without undergoing any net change in temperature as it is drawn through the capillary tube 15 into the test chamber 21 and is thereby maintained at the cryogenic temperature in the test chamber 21.

In the low temperature mode the fluid remains in its liquid phase as it is drawn through the capillary tube 15 into the test chamber 21 until a reservoir of liquid has accumulated in the test chamber 21. Then the capillary heater means 17 warms the capillary tube 15 sufficiently to substantially prevent the flow of any more fluid through the capillary tube 15, and the evacuation means 27 thereupon reduces the pressure in the test chamber 21 sufficiently to lower the boiling temperature of the liquid in the chamber 21 to a desired temperature and thereafter evacuates any gas produced as the liquid boils and thereby maintains the liquid at said temperature.

A test chamber sensor 28, located in the test chamber 21, provides a temperature signal which is utilized to regulate the test chamber heater means 25 and, when operating in the low temperature mode, the evacuation means 27, so as to maintain the desired temperature in the test chamber 21.

Liquid helium having a temperature of about 4.2 degrees Kelvin is preferably used as the fluid 13 in the cryogenic vessel 11. The vessel 11 is of conventional design and typically includes a lid 29 to form a gastight seal, thereby confining the fluid 13 in the vessel 11. In the preferred embodiment, any temperature between about 1.5 degrees Kelvin and about 4.2 degrees Kelvin can be established and maintained when in the low temperature mode, and any temperature between about 4.2 degrees Kelvin and about 20 degrees Kelvin can be established and maintained when in the high temperature mode. In fact, in the high temperature mode most any temperature above 4.2 degrees up to about 300 degrees Kelvin is readily attainable.

In a preferred embodiment the capillary heater means 17 comprises a heater element 30, a temperature sensor 31, and control means 33 such as a microprocessor or the like responsive to the sensor 31 to control the quantity of heat provided by the heater element 30 and thereby to raise the temperature of the capillary tube 15 to a desired value.

In the high temperature mode the control means 33 preferably raises the temperature of the capillary tube to about 10 degrees Kelvin, a temperature which is high enough to boil the liquid as it flows through the capillary tube 15 but not so high as to significantly reduce the rate of mass flow through the capillary tube 15. This temperature is conveniently maintained by using for the temperature sensor 31 a material such as a resistance wire which conducts an electric current in a superconducting mode at any temperature less than about 10 degrees Kelvin; when in superconducting mode the electrical resistance drops to zero, and the control means 33 determines the temperature of the capillary tube 15 by determining whether the sensor 31 is in its superconducting mode.

In the low temperature mode the control means 33 preferably raises the temperature of the capillary tube 15 to about 300 degrees Kelvin. This reduces the rate of mass flow through the capillary tube 15 by some two orders of magnitude, effectively preventing any significant quantity of fluid from flowing through the capillary tube 15

One embodiment includes a test vessel 35 adapted to receive and enclose a test specimen 37 and locatable in the test chamber 21 to maintain the temperature of the specimen 37 approximately equal to the temperature in the test chamber 21. The specimen 37 is suspended at a convenient position in the test vessel 35 by a cable 39 or the like which in turn is suspended from a lid 41 on the test vessel 35. The test vessel 35 can be evacuated through an outlet 43 by a vacuum pump (not shown) or the like. Helium in its gaseous phase can be admitted into the test vessel 35 to provide thermal contact between the specimen 37 and any fluid in the test chamber 21.

Preferably, test chamber isolation means 45 such as a container 47 defining a thermally insulating enclosure 49 is utilized to thermally isolate the test chamber 21 from the liquid 13 in the vessel 11. The enclosure 49 is filled with insulation means such as aluminized mylar or the like.

In a preferred embodiment capillary isolation means such as an impedance capsule 51 thermally isolates the capillary tube 15 from the fluid 13 in the vessel 11. The capsule 51 comprises vertically oriented concentric outer and inner tubes 53 and 55, respectively. Both the outer tube 53 and the inner tube 55 are closed at upper extremities 57 and 59 by lids 61 and 63, respectively. A lower extremity 65 of the outer tube 53 is also closed by a lid 67. A lower extremity 69 of the inner tube 55 extends through the lid 67 and opens into the fluid 13 such that the fluid 13 can flow into the inner tube 55 through the open lower extremity 69 thereof, the inner tube 55 defining an elongated impedance chamber 71.

A space 73 enclosed by the outer tube 53 is evacuated through an evacuation tubelet 75 during manufacture of the impedance capsule 51 to define a thermally insulating vacuum in the space 73, thereby thermally insulating the impedance chamber 71 from the fluid 13 in the vessel 11.

The capillary tube 15 is located in the impedance chamber 71. The fluid flow means 23 comprises, for example, a coupling tube 77 having an inner diameter larger than that of the capillary tube 15 and in fluid communication with the capillary tube 15 and extending out of the impedance chamber 71 and in fluid communication with an opening 79 into the test chamber 21.

A combination of a capillary tube having an inner diameter of about 0.1 millimeters and a length of about ten millimeters, a coupling tube outer diameter of about 0.6 millimeters, and an impedance chamber having an inner diameter of about one millimeter and a length of about 100 millimeters have been found to give satisfactory results, although it will be apparent that other dimensions can be used according to such parameters as the rate of mass flow of the fluid into the test chamber 21. With the dimensions as given, a fluid flow rate of about three cubic centimeters of liquid helium per minute can be achieved when no heat is being provided by the capillary heater means 17.

The outer tube 53 is preferably fabricated from brass, stainless steel or the like. The inner tube 55 and the coupling tube 77 are fabricated from material having low thermal conductivity such as stainless steel or cupronickel. The coupling tube 77 optionally defines a first coil 81 remote from the impedance chamber 71 to provide for cooling of the fluid flowing therethrough toward the test chamber 21 by thermal contact with the fluid 13 in the vessel 11. The coupling tube 77 optionally defines a second coil 83 in the insulating enclosure 49 to better achieve thermal insulation between the test chamber 21 and the fluid 13 in the vessel 11.

The capillary heater element 30 is preferably fabricated from material such as phosphor-bronze resistance wire having a diameter of about 0.08 millimeters. The temperature sensor 31 is made from a superconducting niobium-titanium alloy or the like.

Application of about 0.1 watts of electric power to the heater element 30 will raise the temperature of the capillary tube 15 to about 300 degrees Kelvin. This temperature is high enough not only to boil any liquid helium flowing through the capillary tube 15 but also to reducing the flow rate from three cubic centimeters per minute of liquid helium to about ten cubic centimeters per minute of gaseous helium, a 200-fold reduction which amounts to substantially cutting off the flow of helium through the capillary tube 15.

Apparatus of the kind described above is utilized to regulate the temperature in the test chamber 21 according to the method of drawing the fluid 13 into the test chamber 21 and maintaining the fluid at a desired temperature. More particularly, the method comprises selecting a mode of operation and then drawing the fluid 13 from the cryogenic vessel 11 into the test chamber 21 through the fluid flow path 23 having the capillary tube 15 by partially evacuating the test chamber 21.

Next, if a high temperature mode has been selected, the method comprises applying sufficient heat to the capillary tube 15 to boil any liquid flowing therein and thereby to change the phase of the fluid from liquid to gas as the fluid is drawn through the capillary tube 15 into the test chamber 21, and applying sufficient heat to the gas in the test chamber 21 to warm the gas to the desired temperature and thereafter to maintain the gas at said temperature.

If a medium temperature mode has been selected, the method comprises maintaining the fluid in its liquid phase without any net change of temperature as the fluid is drawn through the capillary tube 15 into the test chamber 21 and thereby maintaining the fluid in the test chamber at the cryogenic temperature.

Finally, if a low temperature mode has been selected, the method comprises maintaining the fluid in its liquid phase as the fluid is drawn through the capillary tube 15 into the test chamber 21 until a reservoir of liquid has accumulated in the test chamber 21, applying sufficient heat to the capillary tube 15 to substantially prevent the flow of any more fluid through the capillary tube 15, reducing the pressure in the test chamber 21 sufficiently to lower the boiling temperature of the liquid in the test chamber 21 to a desired temperature, and evacuating any gas produced as the liquid boils to maintain the liquid at said temperature.

The capillary heater element 30 and the capillary temperature sensor 31 are connected to a control means 33 as shown in FIG. 2. The test chamber heater 25 and the test to the test chamber heater 25 to heat the gas in the test chamber 21 sufficiently to establish and maintain any desired temperature higher than the cryogenic temperature in the test chamber 21.

If the medium temperature mode has been selected, the control means 33 shuts off the heater elements 30 and 25 and activates the evacuation means 27 to draw the fluid 13 into the test chamber 21 and thereby establish the temperature in the test chamber 21 at the cryogenic temperature.

If the low temperature mode has been selected, first a pool of liquid at the cryogenic temperature is accumulated in the test chamber 21 as previously described. Then the control means 33 applies enough power to the capillary heater element 30 to raise the temperature of the capillary tube 15 to 300 degrees Kelvin, thereby substantially cutting off the flow of fluid into the test chamber 21. Then the evacuation means 27 is activated to reduce the pressure in the test chamber 21 enough to cause the liquid therein to boil at the desired temperature. The control means 33 utilizes the signal from the test chamber sensor 28 to control the operation of the evacuation means 27 and thereby maintain the desired temperature in the test chamber 21.

From the foregoing it will be appreciated that the method and apparatus of the invention provide a way to accurately establish and maintain any desired temperature between chamber temperature sensor 28 are also connected to the control means 33, as is the evacuation means 27 which comprises, for example, a vacuum pump. The control means 33 preferably comprises a microprocessor and software. The control means 33 utilizes temperature signals provided by the sensors 31 and 28 and information such as a desired test chamber temperature as provided by an operator to select a mode of operation and to control the application of power to the heater elements 30 and 25 and to the evacuation means 27 to automatically establish and maintain the desired temperature in the test chamber 21.

If the high temperature mode has been selected, the control means 33 uses the signal from the capillary sensor 31 to apply enough power to the capillary heater element 30 to maintain the temperature of the capillary tube 15 at about 10 degrees Kelvin. The evacuation means 27 is activated, drawing the fluid 13 from the vessel 11 into the impedance chamber 71 through the open extremity 69 of the inner tube 55 and thence through the capillary tube 15 and the coupling tube 77 into the test chamber 21. The fluid boils as it flows through the capillary tube, and the resulting gas is cooled back to the cryogenic temperature as it flows through the coupling tube 77. The control means 33 uses the signal from the test chamber sensor 28 to apply enough power about 1.5 and 300 degrees Kelvin in a cryogenic test chamber. Any tendency of the temperature to oscillate when operating in a high temperature mode is suppressed, and cryogenic fluid in its liquid phase is kept out of the chamber and thereby prevented from interfering with experiments being performed therein. When operating in the low temperature mode, the chamber is readily cooled to temperatures well below that of the cryogenic fluid.

Although certain specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

We claim:

1. Temperature regulation apparatus comprising:

a cryogenic vessel adapted to contain a fluid in a liquid phase at a cryogenic temperature;

a capillary tube located in the cryogenic vessel;

capillary heater means in thermal communication with the capillary tube;

means defining a test chamber in the cryogenic vessel in spaced-apart relation to the capillary tube;

fluid flow means defining a fluid flow path between the capillary tube and the test chamber;

test chamber heater means in thermal communication with the test chamber; and evacuation means operative to partially evacuate the test chamber to draw fluid from the cryogenic vessel through the capillary tube and the fluid flow means into the test chamber, the apparatus being operative to regulate the temperature in the test chamber by maintaining the fluid therein at a desired temperature and operable in a high temperature mode wherein the capillary heater means is operative to warm the capillary tube sufficiently to boil any liquid flowing therein and thereby to change the phase of the fluid from liquid to gas as the fluid is drawn through the capillary tube into the test chamber and wherein the test chamber heater means is operative to warm any gas in the test chamber to a desired temperature and thereafter to maintain the gas at said temperature, operable in a medium temperature mode wherein the fluid remains in its liquid phase without undergoing any net change in temperature as it is drawn through the capillary tube into the test chamber and is thereby maintained at the cryogenic temperature in the test chamber, and operable in a low temperature mode wherein the fluid remains in its liquid phase as it is drawn through the capillary tube into the test chamber until a reservoir of liquid has accumulated in the test chamber, the capillary heater means thereupon being operative to warm the capillary tube sufficiently to substantially prevent the flow of any more fluid through the capillary tube, and the evacuation means thereupon being operative to reduce the pressure in the test chamber sufficiently to lower the boiling temperature of the liquid in the chamber to a desired temperature and thereafter to evacuate any gas produced as the liquid boils and thereby to maintain the liquid at said temperature.

2. Apparatus according to claim 1 wherein the cryogenic temperature is about 4.2 degrees Kelvin.

3. Apparatus according to claim 2 wherein the desired temperature when operating in the low temperature mode includes any temperature between about 1.5 degrees Kelvin and about 4.2 degrees Kelvin.

4. Apparatus according to claim 2 wherein the desired temperature when operating in the high temperature mode includes any temperature between about 4.2 degrees Kelvin and about 20 degrees Kelvin.

5. Apparatus according to claim 1 wherein the capillary heater means comprises a heater element, a temperature sensor, and control means responsive to the sensor to control the quantity of heat provided by the heater element and thereby to raise the temperature of the capillary tube to a desired value.

6. Apparatus according to claim 5 wherein the control means is operative in the high temperature mode to raise the temperature of the capillary tube to about 10 degrees Kelvin.

7. Apparatus according to claim 6 wherein the temperature sensor comprises a material which conducts a electric current in a superconducting mode at any temperature less than about 10 degrees Kelvin and wherein the control means determines the temperature of the capillary tube by determining whether the sensor is in the superconducting mode.

8. Apparatus according to claim 5 wherein the control means is operative in the low temperature mode to raise the temperature of the capillary tube to about 300 degrees Kelvin.

9. Apparatus according to claim 1 and further comprising a test vessel adapted to receive and enclose a test specimen and locatable in the test chamber to maintain the temperature of the specimen approximately equal to the temperature in the test chamber.

10. Apparatus according to claim 1 and further comprising test chamber isolation means to thermally isolate the test chamber.

11. Apparatus according to claim 1 wherein the capillary tube has an inner diameter of about 0.1 millimeters and a length of about ten millimeters.

12. Apparatus according to claim 1 and further comprising capillary isolation means to thermally isolate the capillary tube.

13. Apparatus according to claim 12 wherein the capillary isolation means comprises an impedance capsule defining an elongated impedance chamber having an inner diameter of about 1 millimeter and a length of about 100 millimeters.

14. Apparatus according to claim 13 wherein the fluid flow means comprises a coupling tube having an outer diameter of about 0.6 millimeters.

15. In cryogenic apparatus of the kind including a cryogenic vessel adapted to contain a fluid in a liquid phase at a cryogenic temperature, means defining a test chamber in the cryogenic vessel, test chamber heater means in thermal communication with the test chamber, an opening to admit fluid from the cryogenic vessel to the test chamber, evacuation means operative to partially evacuate the test chamber to draw fluid from the cryogenic vessel through the opening into the test chamber, and a test vessel adapted to receive and enclose a test specimen and located in the test chamber to maintain the temperature of the specimen approximately equal to the temperature in the test chamber, an improvement for regulating the temperature in the test chamber by maintaining the fluid therein at a desired temperature, the improvement comprising:

an impedance capsule located in the cryogenic vessel in spaced apart relation to the test chamber and defining an elongated impedance chamber;

a capillary tube located in the impedance chamber;

capillary heater means in thermal communication with the capillary tube; and a coupling tube having a diameter larger than that of the capillary tube and in fluid communication with the capillary tube and extending out of the impedance chamber and in fluid communication with the opening to the test chamber, operable in a high temperature mode wherein the capillary heater means is operative to warm the capillary tube sufficiently to boil any liquid flowing therein and thereby to change the phase of the fluid from liquid to gas as the fluid is drawn through the capillary tube into the test chamber and wherein the test chamber heater means is operative to warm any gas in the test chamber to a desired temperature and thereafter to maintain the gas at said temperature, operable in a medium temperature mode wherein the fluid remains in its liquid phase without undergoing any net change in temperature as it is drawn through the capillary tube into the test chamber and is thereby maintained at the cryogenic temperature in the test chamber, and operable in a low temperature mode wherein the fluid remains in its liquid phase as it is drawn through the capillary tube into the test chamber until a reservoir of liquid has accumulated in the test chamber, the capillary heater means thereupon being operative to warm the capillary tube sufficiently to substantially prevent the flow of any more fluid through the capillary tube, and the evacuation means thereupon being operative to reduce the pressure in the test chamber sufficiently to lower the boiling temperature of the liquid in the chamber to a desired temperature and thereafter to evacuate any gas produced as the liquid boils and thereby to maintain the liquid at said temperature.

16. An improvement according to claim 15 wherein the desired temperature when operating in the low temperature mode includes any temperature between about 1.5 degrees Kelvin and about 4.2 degrees Kelvin.

17. An improvement according to claim 15 wherein the desired temperature when operating in the high temperature mode includes any temperature between about 4.2 degrees Kelvin and about 20 degrees Kelvin.

18. An improvement according to claim 15 wherein the capillary heater means comprises a heater element, a temperature sensor, and control means responsive to the sensor to control the quantity of heat provided by the heater element and thereby to raise the temperature of the capillary tube to a desired value.

19. An improvement according to claim 18 wherein the control means is operative in the high temperature mode to raise the temperature of the capillary tube to about 10 degrees Kelvin.

20. An improvement according to claim 19 wherein the temperature sensor comprises a material which conducts an electric current in a superconducting mode at any temperature less than about 10 degrees Kelvin and wherein the control means determines the temperature of the capillary tube by determining whether the sensor is in the superconducting mode.

21. An improvement according to claim 18 wherein the control means is operative in the low temperature mode to raise the temperature of the capillary tube to about 300 degrees Kelvin.

22. An improvement according to claim 15 wherein the capillary tube has an inner diameter of about 0.1 millimeters and a length of about ten millimeters.

23. An improvement according to claim 15 wherein the coupling tube has an outer diameter of about 0.6 millimeters and wherein the impedance chamber has an inner diameter of about one millimeter.

24. In cryogenic apparatus of the kind including a cryogenic vessel adapted to contain a fluid in a liquid phase at a cryogenic temperature, means defining a test chamber in the cryogenic vessel, and a test vessel adapted to receive and enclose a test specimen and located in the test chamber to maintain the temperature of the specimen approximately equal to the temperature in the test chamber, a method of regulating the temperature in the test chamber by drawing fluid into the test chamber and maintaining the fluid at a desired temperature, the method comprising:

selecting a mode of operation;

drawing fluid from the cryogenic vessel into the test chamber through a fluid flow path having a capillary tube by partially evacuating the test chamber;

if a high temperature mode has been selected, applying sufficient heat to the capillary tube to boil any liquid flowing therein and thereby to change the phase of the fluid from liquid to gas as the fluid is drawn through the capillary tube into the test chamber, and applying sufficient heat to the gas in the test chamber to warm the gas to the desired temperature and thereafter to maintain the gas at said temperature;

if a medium temperature mode has been selected, maintaining the fluid in its liquid phase without any net change of temperature as the fluid is drawn through the capillary tube into the test chamber and thereby maintaining the fluid in the test chamber at the cryogenic temperature; and if a low temperature mode has been selected, maintaining the fluid in its liquid phase as the fluid is drawn through the capillary tube into the test chamber until a reservoir of liquid has accumulated in the test chamber, applying sufficient heat to the capillary tube to substantially prevent the flow of any more fluid through the capillary tube, reducing the pressure in the test chamber sufficiently to lower the boiling temperature of the liquid in the test chamber to a desired temperature, and evacuating any gas produced as the liquid boils to maintain the liquid at said temperature.

25. A method according to claim 24 wherein the desired temperature when operating in the low temperature mode includes any temperature between about 1.5 degrees Kelvin and about 4.2 degrees Kelvin.

26. A method according to claim 24 wherein the desired temperature when operating in the high temperature mode includes any temperature between about 4.2 degrees Kelvin and about 20 degrees Kelvin.

27. A method according to claim 24 wherein in the high temperature mode the capillary tube is heated to about 10 degrees Kelvin.

28. A method according to claim 24 wherein in the low temperature mode the capillary tube is heated to about 300 degrees Kelvin.

* * * * *

UNITED STATES PATENT AND TRADEMARK OFFICE
CERTIFICATE OF CORRECTION

PATENT NO. : 4,848,093
DATED : July 18, 1989
INVENTOR(S) : Michael B.Simmonds, Ronald E. Sager It is certified that error appears in the above-identified patent and that said Letters Patent is hereby corrected as shown below:

Column 1, line 34, please correct "10 the test chamber" to --the test chamber--.

Column 3, line 45, please correct "but no so high" to --but not so high--.

Column 9, line 21, please remove the block of text beginning with the words "chamber temperature..." and ending with the words "...enough power" at Column 9, line 47, and insert this text at Column 8, line 62, between the words "test" and "to".

Signed and Sealed this

Eighth Day of January, 1991

*Attest:*

HARRY F. MANBECK, JR.

*Attesting Officer*

*Commissioner of Patents and Trademarks*